US006038835A

United States Patent [19]

de Haan et al.

[11] Patent Number: 6,038,835

[45] Date of Patent: Mar. 21, 2000

[54] APPARATUS AND METHOD FOR INSERTING DOCUMENTS INTO ENVELOPES

[75] Inventors: Hendrik Andries de Haan, Bergum; Christiaan Antoon Munneke, Surhuisterveen, both of Netherlands

[73] Assignee: Hadewe B.V., Drachten, Netherlands

[21] Appl. No.: 08/775,031

[22] Filed: Dec. 27, 1996

[30] Foreign Application Priority Data

Dec. 29, 1995 [NL] Netherlands ..... 1002002

[51] Int. Cl.[7] ..... B65B 35/50

[52] U.S. Cl. ..... 53/460; 53/284.3; 53/377.6; 53/569

[58] Field of Search ..... 53/284.3, 206, 53/569, 460, 377.6, 376.3, 381.5, 381.6, 381.7

[56] References Cited

U.S. PATENT DOCUMENTS

| | | | |
|---|---|---|---|
| 2,728,178 | 12/1955 | Kern | 53/284.3 |
| 3,242,637 | 3/1966 | Wills | 53/284.3 |
| 3,253,384 | 5/1966 | Huck | 53/284.3 |
| 4,010,598 | 3/1977 | Mueller | 53/376 |
| 4,169,341 | 10/1979 | Roetter et al. | 53/569 |
| 4,312,169 | 1/1982 | Golicz | 53/206 |
| 4,337,609 | 7/1982 | Foster et al. | 53/569 |
| 4,766,715 | 8/1988 | Dimur | 53/381 |
| 4,903,457 | 2/1990 | Dimur | 53/569 |
| 5,301,935 | 4/1994 | Miki | 270/45 |
| 5,408,811 | 4/1995 | Satake | 53/569 |
| 5,410,860 | 5/1995 | Coudray et al. | 53/569 |
| 5,475,968 | 12/1995 | Linder | 53/569 |
| 5,618,375 | 4/1997 | Suzuki | 156/442.3 |

FOREIGN PATENT DOCUMENTS

| | | |
|---|---|---|
| 31 37 033 | 4/1982 | Germany . |
| 37 04 241 | 8/1988 | Germany . |
| 2268148 | 1/1994 | United Kingdom . |
| 95/13197 | 5/1995 | WIPO . |
| WO 95/13197 | 5/1995 | WIPO . |

*Primary Examiner*—Peter Vo
*Assistant Examiner*—James P. Calve
*Attorney, Agent, or Firm*—Burns, Doane, Swecker & Mathis, L.L.P.

[57] ABSTRACT

In an inserting apparatus an envelope holder comprises a first envelope support connecting to a document feed path, for holding an envelope in a filling position in or against a first surface, and a second envelope support connecting to an envelope discharge path, for carrying another envelope in or against a second surface and in an overlapping relation with an envelope simultaneously held in the filling position. Also described is a method in which an envelope to be filled is brought into the filling position before the preceding, filled envelope has left a feed-through path and this envelope brought into the filling position temporarily overlaps the filled envelope. The proposed apparatus and method enable an increased processing capacity.

24 Claims, 5 Drawing Sheets

APPARATUS AND METHOD FOR INSERTING DOCUMENTS INTO ENVELOPES

FIELD AND BACKGROUND OF THE INVENTION

This invention relates to an apparatus for inserting documents into envelopes, comprising a document feed path, an envelope feed path, an envelope holder with at least one envelope support, operatively connecting to the document feed path and the envelope feed path, for holding an individual envelope in a filling position at least partly in or against a particular first surface, and for subsequently guiding that envelope towards arid thereafter into a second surface offset or tilted with respect to the first surface, means for introducing at least one document into an envelope being held in the filling position, and an envelope discharge path operatively connecting to the envelope holder.

This invention also relates to a method for inserting documents into envelopes, with a cycle comprising; feeding at least one document along a document feed path to an envelope positioned in a filling position in or against a first surface, thereafter introducing that document or those documents into that envelope, subsequently discharging the filled envelope from the filling position via a feed-through path into or against a second surface offset or turned relative to the first surface and an envelope discharge path, and bringing a next envelope to be filled into the filling position.

Such an apparatus and such a method are known from British patent application 2,268,148. The envelope holder of this known apparatus is equipped with an envelope carrier which is pivotable about a shaft between three positions in which it aligns with different transport paths on its side remote from the shaft. In a first position the envelope holder connects to an envelope feed path via which path an envelope can be introduced into the envelope holder. In a second position the envelope holder connects to a document feed path, via which path a document can be inserted into an envelope in the envelope holder. In a third position the envelope holder connects to a discharge path, via which path the filled envelope can be discharged.

International patent application WO 95/13197 discloses an apparatus and a method for inserting items into envelopes, in which an envelope is carried into a filling position in a direction transverse to the walls of that envelope. As a result, carrying an envelope into the filling position can be carried out relatively quickly.

Drawbacks of these known apparatuses and methods for inserting items into envelopes are that in operation much space in the material stream, and hence time, must be reserved for bringing an envelope to be filled into a filling position. This has an adverse effect on thc number of envelopes that can be filled per unit time, even if the envelopes are placed in the reserved space very quickly.

SUMMARY OF THE INVENTION

The object of the invention is to provide an apparatus and a method for inserting documents into envelopes, whereby less space and time need to be reserved for bringing an envelope to be filled into the filling position.

This object is achieved, in accordance with the invention, in that in an apparatus as initially indicated, the envelope holder comprises at least two envelope supports, a first of the envelope supports being located in a position operatively connecting to the document feed path for holding an envelope in a filling position at least partly in or against the first surface, and the second of the envelope supports being located in a position for carrying another envelope, at least partly, in overlapping relationship with an envelope which is simultaneously held in the filling position by the first-mentioned envelope support.

The invention further provides that in a method as intially indicated, in each case, the next envelope to be filled is brought into the filling position before the preceding, filled envelope has left the feed-through path and this next envelope brought into the filling position temporarily overlaps the preceding, filled envelope in the feed-through path.

Owing to the apparatus according to the invention comprising two or more envelope supports making it possible to simultaneously hold an envelope to be filled in the filling position and an already filled envelope in a surface offset with respect to the filling position, the filling position can be cleared again for receiving a next envelope a very short time after the filling of an envelope. When using the method according to the invention, this is utilized by bringing the next envelope into the filling position so early that in the filling position it overlaps the preceding envelope. By virtue of this temporary overlap, considerably less space needs to be reserved in the document stream for envelopes to be filled and a next envelope can be brought into the filling position to be filled a shorter time after the filling of a preceding envelope than is the case in the known apparatuses.

The invention is based on the insight that the above-mentioned known apparatuses require individual reservation of time for bringing the envelope into the filling position, since a next envelope cannot be brought into the filling position until a preceding envelope has left the filling position or the envelope holder in a direction parallel to the walls of that envelope. Even if envelopes are brought into the filling position quickly, then still space must be reserved between successive sets of documents for entering the envelopes to be filled into the material strewn, which limits the number of documents that can be processed per unit time at a given displacement speed of documents in the inserting apparatus. This drawback is obviated in the apparatus and the method according to the invention in that the envelopes can be brought into the filling position in a condition where they overlap the preceding envelope which has been brought at least partly out of the surface of the filling position, as a result of which the space in the material stream that is temporarily needed for the empty envelope is reduced considerably.

Once an envelope has been filled, the length and the width of the assembly of that envelope and the documents placed therein are normally (given a normal, suitably chosen envelope size) only marginally larger than the length and the width of the set of documents in question, so that for that condition no appreciable amount of additional space needs to be reserved in the material stream.

Further objects, embodiments and advantages of the invention appear from the following description of an exemplary embodiment which is presently preferred most and two alternative exemplary embodiments, with reference to the drawing, and from the claims.

DESCRIPTION OF MODES FOR CARRYING OUT THE INVENTION

Figure 2:
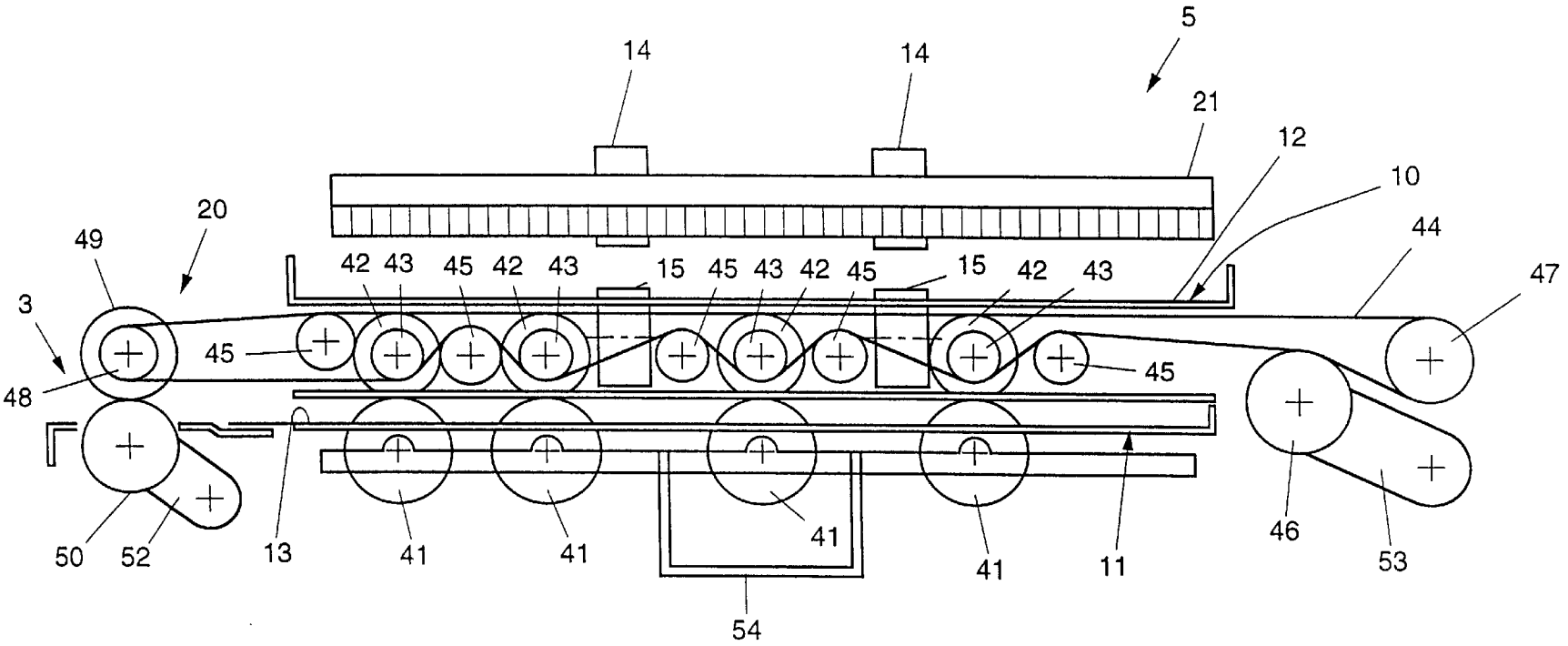
FIG. 2 is an elevation in cross section taken on the line II—II of FIG. 1.
Figure 3A:
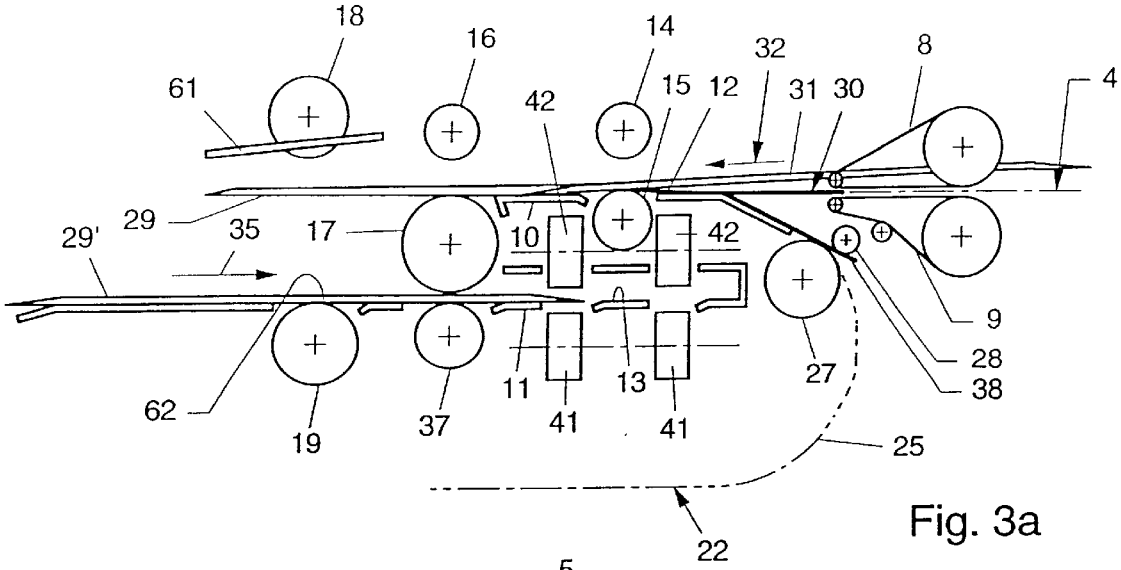
FIGS. 3A, 3B and 3C are more highly schematized representations of the apparatus according to FIG. 1 in operating conditions occurring during successive phases of a cycle of the method according to the invention.
Figure 3B:
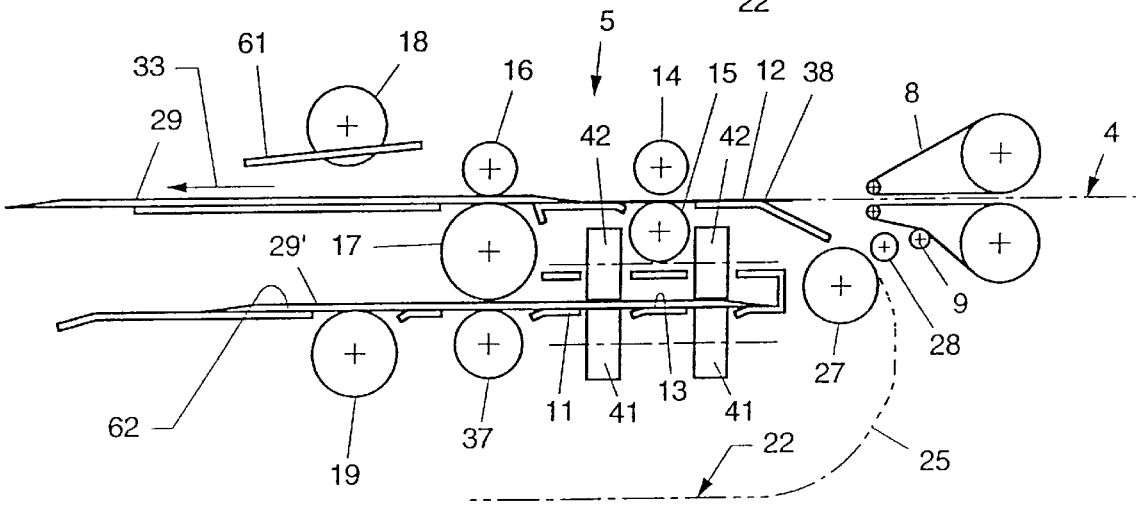
Figure 3C:
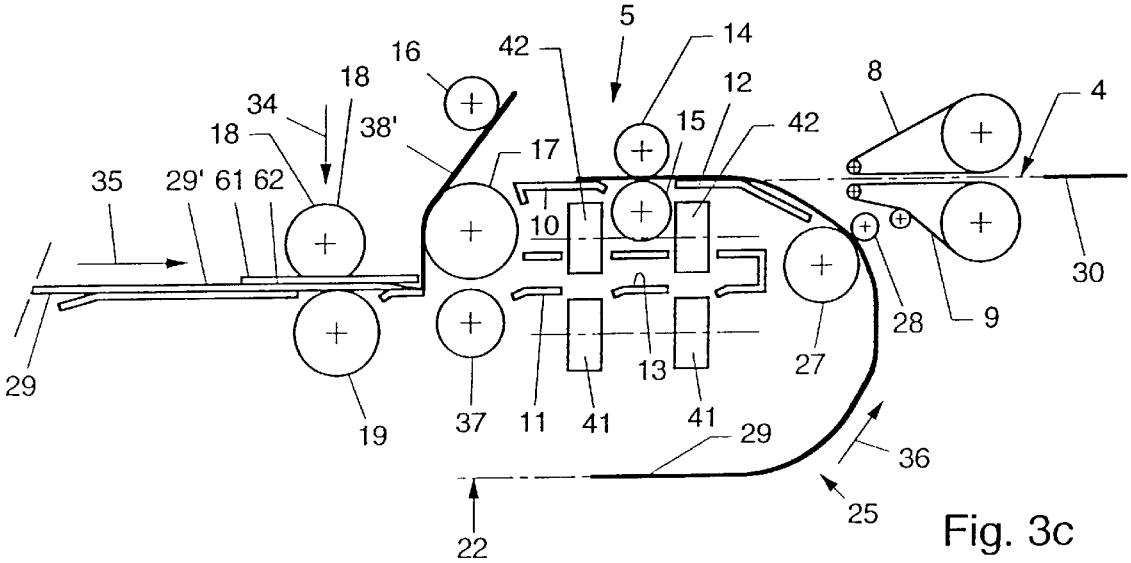

The invention will be explained first of all with reference to the most preferred exemplary embodiment shown in FIGS. 1–2 and the successive operational phases of that apparatus as represented in FIGS. 3A–3C. Next, the alternative exemplary embodiments illustrated in FIGS. 4–5 will be further described and explained.

Figure 1:
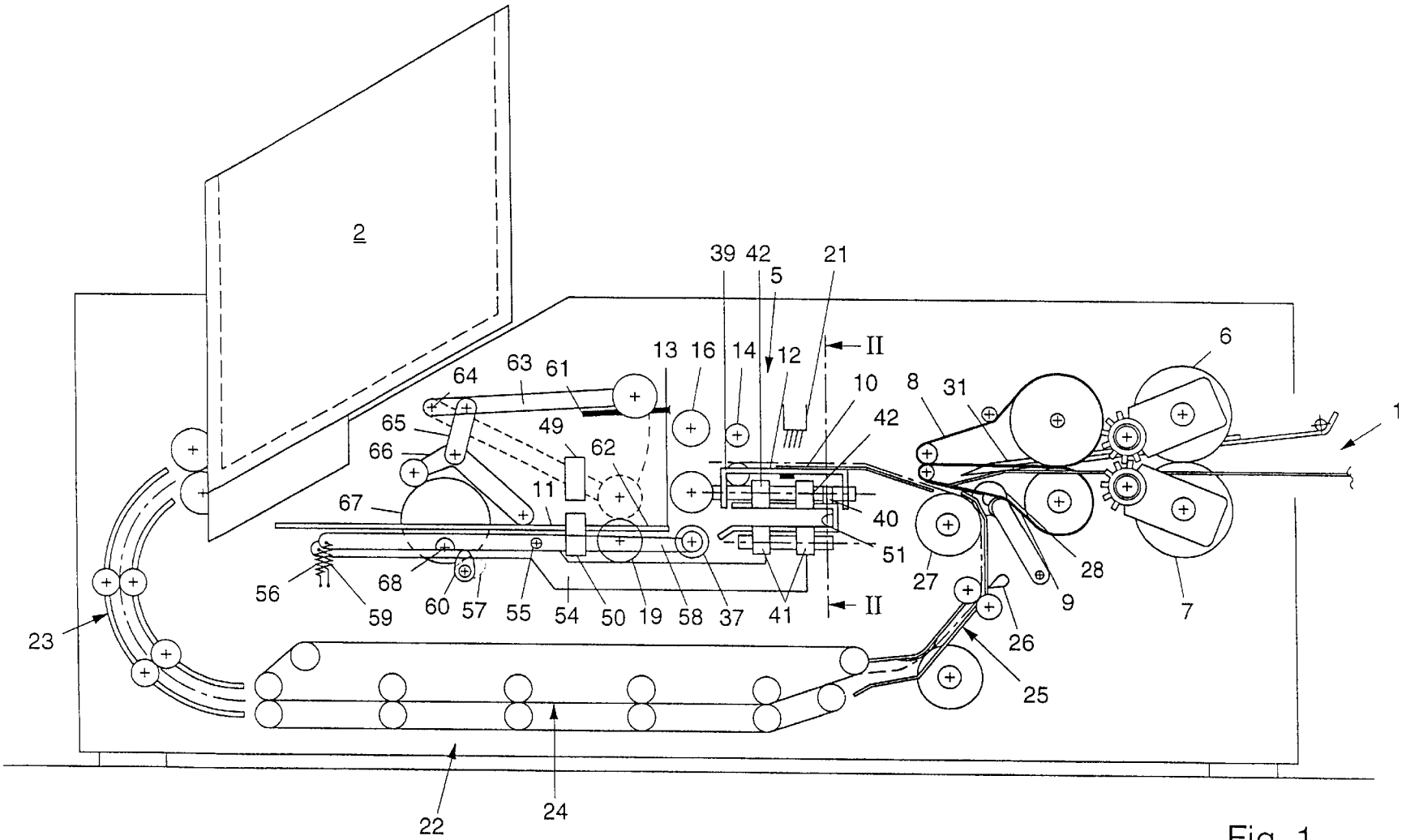
FIG. 1 is a cutaway, slightly schematized representation in side elevation of an inserting apparatus according to the invention.

As appears from FIG. 1, the inserting apparatus shown in FIGS. 1 and 2 has an inlet 1 for feeding documents and a supply holder 2 for receiving a stock of envelopes to be supplied. The apparatus further has an outlet 3 for the exit of filled envelopes. This outlet 3 is directed transversely to the inlet for feeding documents and represented most clearly in FIG. 2.

To the inlet 1 for documents can be connected, for instance, stations for dispensing and optionally gathering and folding documents, known per se. To the outlet 3 can be connected, for instance, a known holder for receiving filled envelopes or a sorting apparatus.

From the document inlet 1 extends a document feed path 4 to an envelope holder 5. Arranged on opposite sides of the document feed path 4 are conveyor rollers 6, 7 and conveyor belts 8, 9 for controlled feeding of separate documents or documents stacked to form sets, to the envelope holder and inserting them into an envelope held in the filling position. For a further description of the roller set 6, 7 along the document feed path 4, reference is made to applicant's Dutch patent application 1001828, the content of which is incorporated herein by reference. For a further description of the conveyor belts 8, 9 on opposite sides of the document feed path, reference is made to applicant's Dutch patent application filed simultaneously with the instant patent application, entitled "Inserting apparatus", the content of which is incorporated herein by reference.

The envelope holder 5 operatively connects to the document feed path 4 and is made up of a first envelope support 10 and a second envelope support 11. Both envelope supports 10, 11 are designed as stationary supports for envelopes.

The first envelope support 10 is disposed in a position operatively aligning with the document feed path, for supporting a portion of an envelope to be filled that is contiguous to the flap, in a filling position against a first surface 12 formed by the top surface of the envelope support 10. For the purpose of guiding envelopes from the filling position to a second surface 13, offset with respect to the first surface 12, the envelope holder 5 is provided with conveyor rollers 14, 15, and 16, 17 on opposite sides of the first surface 12 and with a press-on roller 18 on the side of the first envelope support 10 remote from the document feed path 4. This press-on roller is reciprocally movable between a first position on the side of the first surface 12 remote from the second surface 13 and a second position near the side of the second surface 13 proximal to the first surface and opposite a conveyor roller 19 on the side of the second surface 13 remote from the first surface 12. The conveyor rollers 14, 16 on the side of the first surface 12 remote from the second surface 13 have two operating conditions: firstly, the operating condition shown, in which the rollers 14, 16 are held spaced from the opposite conveyor rollers 15 and 17, respectively, and secondly, an operating condition in which the rollers 14, 16 are urged towards the opposite conveyor rollers 15 and 17, respectively.

The second envelope support 11 operatively aligns with an envelope discharge path 20 leading to the outlet 3 and has an upwardly facing surface defining the second surface 13. An envelope can be supported by the second envelope support 11 in a position in which it overlaps an envelope simultaneously held in the filling position by the first envelope support 10.

Arranged above the first envelope support 10 is a flap wetter 21 which, in a manner known per se, can be moved to the envelope support 10 for wetting a passing flap of an envelope.

From the supply holder 2, which is adapted in a manner known per se for dispensing individual envelopes one by one, extends an envelope feed path 22 for feeding individual envelopes one by one to the envelope holder 5. The envelope feed path 22 is made up of a first, curved portion 23 leading from the supply holder 2 to a level under the envelope holder 5; a second portion 24 passing under the envelope holder 5; and a third portion 25 curving towards the envelope holder 5. Arranged along the third portion 25 of the envelope feed path 22 is a flap opener 26 for opening a flap contiguous to a wall of an envelope along a trailing fold. Further, the envelope feed path includes a pair of opposite rollers 27, 28 for retaining the flap of an envelope supported in the filling position by the first envelope support 10.

The preferred practice of the method according to the invention for inserting documents using the apparatus shown in FIGS. 1 and 2 will now be described with reference to FIGS. 3A–3C.

A cycle according to the discussed embodiment for processing an envelope 29 comprises in each case:

firstly, feeding a content 30 consisting of a document or several documents along the document feed path 4 to the envelope 29 which is positioned in the filling position against the first surface 12 (see FIGS. 3C and 3A), secondly, inserting that content 30 into the envelope 29 in a direction indicated by an arrow 32, whereby this content 30 is guided into that envelope over the flap 38 of the envelope 29 by a guide finger 31 inserted into the envelope 29 (see FIG. 3A), thirdly, subsequently discharging the filled envelope 29 from the filling position, first in a direction indicated by an arrow 33 parallel to the first surface (see envelope 29 in FIG. 3B), then via a feed-through path in a direction transverse to the first and the second surface, as indicated by an arrow 34, as far as against the second surface 13 (see envelope 29' in FIG. 3C) and along the second surface 13 in a direction indicated by an arrow 35 (see envelope 29 in FIG. 3C and envelope 29' in FIG. 3A) and finally along the envelope discharge path 3 (see envelope 29' in FIG. 3B).

When feeding an envelope 29 to the filling position, the conveyor roller 14 on the side of the first surface 12 remote from the second surface 13 is urged towards the opposite conveyor roller 15 (see FIG. 3C), so that the transport of the arriving envelope 29 can be accurately controlled. The transport of the envelope 29 is stopped when the rollers 14, 15, counting from the moment when the leading edge has been detected by a photosensitive cell 39 (see FIG. 1), have completed a pre-set angular displacement. This angular displacement is dependent on the size in the displacement device 32 of the envelopes that are being processed.

Each time before the leading edge of the envelope has reached the path of the press-on roller 18 between the two positions thereof, the press-on roller 18 is brought into its position remote from the second surface 13, so that it assumes a position on the side of the envelope 29 in the filling position remote from the second surface 13.

When the envelope 29 has reached the filling position (see FIG. 3A), the conveyor roller 14 is lifted away from the opposite conveyor roller 15. The conveyor roller 16 remains in a position remote from the opposite roller 17. Thus no pressure is applied to the walls of the envelope 29 in the filling position, so that the insertion of documents into that envelope is not impeded. The envelope 29 is retained against the frictional force exerted during the insertion of the documents 30, inasmuch as the flap 38 is retained in a nip between the rollers 27, 28 of the envelope feed path 22.

After the insertion of the content 30 has been completed, these rollers 27, 28 of the envelope feed path 22 are released and the rollers 14, 16 are urged back towards the opposite rollers 15 and 17, respectively. Then the rollers 15, 17 are driven, so that the envelope is moved in the direction indicated by the arrow 33 (see FIG. 3B). Concurrently, at a suitable moment the wetter 21 is pressed against the passing flap 38 for wetting gummed surfaces present on that flap.

After the rollers 16, 17 have completed a pre-set angular displacement, the roller 16 is moved away from the opposite roller 17 again, and the press-on roller 18 is moved to the second surface (see FIG. 3B). As a result, the envelope is pressed against the second surface 13 and the closure of the flap 38' is initiated.

An advantage of urging a filled envelope 29' to the second surface 13 by means of a press-on element is that envelopes having different sizes in the direction indicated by the arrow 33 can be processed without having to adjust a stop or the like.

As appears from the successive positions of the envelope 29 in FIG. 3B, 29' in FIG. 3C and 29' in FIG. 3A, the flap 38' of the filled envelope 29', during displacement of a folding edge of that envelope 29' extending along that flap 38, is folded over from a position against the first surface 12 to a position against the second surface 13 into a position projecting transversely from walls of the envelope 29'. Thus the displacement of the envelope 29' into the position against the second surface is utilized to initiate the closure of the flap 38.

Owing to the circumstance that it takes some time for the moisture applied to the gum to lead to the softening and dissolution of the gum, it is, incidentally, not a problem when wetted gummed surfaces of the flap touch the roller 16. Since the angular displacement of the rollers 16, 17 prior to the lift of the roller 16 is dependent on the required displacement of the folding edge of flap 38 of the envelope 29, and the position of that folding edge in the filling position is, in principle, identical for each size of envelope, the angular displacement of the rollers 16, 17 in reaction to which the roller 16 is lifted is, in principle, likewise identical for all sizes of envelopes.

When the envelope 29' has been pressed against the second surface 13, a roller 19 located opposite the press-on roller 18 is driven, so that the envelope 29' is moved in the direction indicated by an arrow 35 (see FIG. 3C). As soon as the now leading edge of the envelope 29' has been brought into the nip between the still rotating roller 17 and a roller 37 on the opposite side of the second surface, the press-on roller 18 is returned again to its position remote from the second surface 13, so that a next envelope can be brought into the filling position and between the press-on roller, 18 and the second surface 13 (see FIG. 3A).

Meanwhile, the displacement of the envelope 29' is continued, with the rollers 17, 37 functioning as closing rollers which complete the closure of the flap 38' inasmuch as the roller 17 is driven further until a photosensitive cell 40 (see FIG. 1) has detected the now leading edge of the envelope 29'. In reaction to the detection of the leading edge of the envelope 29' by the detector 40, the drive of the roller 17 is stopped and the roller 37 is brought from a condition where it is pressed against the roller 17 into a condition where it is moved away from the roller 17. Also, discharge rollers 41 on the side of the second surface 13 remote from the first surface 12 are pressed towards opposite discharge rollers 42 and driven (see FIG. 3B), so that the envelope 29' is discharged along the discharge path 3 (see FIG. 2) in a direction perpendicular to the plane of the paper.

As appears from FIG. 3C, concurrently with the displacement of the filled envelope 29' along the second surface 13, a next envelope 29 is carried into the filling position in a direction indicated by an arrow 36. As appears from FIG. 3A, this next envelope 29 to be filled, when it has reached the tilling position, overlaps the filled envelope 29'.

Owing to the feature that in the apparatus according to the invention as shown, different envelope supports 10, 11 hold and guide an envelope 29 to be filled in the filling position in a first surface 12 and, at the same time, an already filled envelope 29' in a second surface 13, offset with respect to the first surface 12, the filling position can be cleared for receiving a next envelope 29 in a very short time span after the filling of an envelope 29. The next envelope 29 is then brought into the filling position so early that in the filling position it overlaps the preceding, already filled, envelope 29' which by then is disposed in a position outside the first surface 12. By virtue of this temporary overlap, considerably less space than in known methods and known apparatuses needs to be reserved in the document stream for merging the envelopes to be filled, and a next envelope 29 can be brought into the filling position and be filled a shorter time after the filling of a preceding envelope 29' than is the case in the known apparatuses.

Owing to the apparatus shown further comprising conveying means for transferring a filled envelope from one envelope support 10 to the other envelope support 11, which conveying means are formed by the conveyor rollers 14–17 along the first surface 12 and the movable press-on roller 18, and owing to the envelope supports being arranged stationarily, the displacement of the filled envelopes 29, 29' from the first surface 12 to the second surface 13 can be realized in a simple manner. In particular, owing to the envelope supports 10, 11 always remaining in place, no complicated construction occupying a great deal of space is needed for simultaneously displacing different envelope supports from the first surface 12 to the second surface 13 and from the second surface 13 to the first surface 12.

Between the closing rollers 17, 37 located downstream of the first envelope support 10, the envelope 29' carried out of the first surface can be closed by passing it parallel to the Second surface 13 between those closing rollers 17, 37, with a folding edge between the flap 38' and a wall of that envelope 29' in leading position (see displacement of the envelope 29' in FIGS. 3C and 3A). owing to this displacement, directed against the feeding direction of documents, taking place along a path extending along the second surface 13 offset relative to the first surface 12, the filling of a next envelope 29 is not impeded by the already filled envelope 29' moving against the filling direction 32.

At least when processing envelopes 29 with a largest possible size in the filling direction 32, and, in the case of the apparatus shown, also when processing most envelopes smaller in the filling direction 32, the distance over which the envelope 29, after being filled and prior to being closed, is displaced is much less than the length of that envelope 29 in the filling direction. This also has a favorable effect on the processing rate, because the distance over which the envelope 29 must be discharged along the first surface 12 before it can be moved to the second surface 13 to clear the filling position is relatively short.

The closing roller 17 located on the side of the second surface 13 proximal to the first surface 12 further has a peripheral portion located approximately in the same plane as the first surface 12 defined by the first envelope support 10. As a result, the closing roller 17 also fulfils the function of conveyor roller for discharging filled envelopes 29 from the first envelope support. During rotation of the closing roller 17 for the purpose of closing an already filled envelope 29' moving along the second surface 13, an envelope 29 yet to be filled or already filled can be present in the filling position without being transported by the roller 17. Effective engagement of the envelope 29 in the filling position by the closing roller 17 is prevented in that the conveyor roller 16 on the side of the first surface 12 remote from the second surface 13, cooperating with the closing roller 17, can be lifted away from the closing roller 17.

Owing to the closing roller 17 being moreover located next to the first envelope support 10, an envelope 29, after being moved away from the envelope support 10, is urged towards the second surface 13 by a peripheral portion of the closing roller 17 remote from the envelope support 10. In particular the flap 38 of the envelope 29 is effectively urged to the second surface 13 by the closing roller, as appears from FIG. 3C.

The assembly of conveyor rollers 41, 42 and the envelope discharge path 3 for discharging filled and closed envelopes in a direction transverse to the feed paths 4, 22 is represented most clearly in FIG. 2. Four sets of opposite rollers 41, 42 are rotatable about shafts directed transversely to the shaft of the closing roller and parallel to the second surface 13, for the purpose of displacing filled and closed envelopes transversely to the direction of displacement during closure. Owing to several sets of rollers 41, 42 being distributed in the conveying direction across the width of the second envelope support 11, an envelope can be reliably discharged in spite of the roller pairs 41, 42 engaging an envelope exclusively adjacent an edge thereof. For driving the upper rollers 42 of the roller pairs 41, 42, they are non-rotatably coupled with toothed gears 43 over which a toothed belt 44 is trained. The toothed belt 44 further passes over a number of divert rollers 45, a tensioning roller 46, a toothed driving gear 47 and a toothed gear 48, which is non-rotatably coupled with a conveyor roller 49 of the envelope discharge path 3. The tensioning roller 46 is rotatably suspended from a pivotable rocker 53. This rocker 53 is urged towards the toothed belt 44 by a spring, not shown.

Arranged opposite the conveyor roller 49 of the envelope discharge path 3 is a further conveyor roller 50 which is suspended from a pivotable rocker 52. The conveyor rollers 49, 50 of the envelope discharge path 3 are arranged at a considerably greater distance from a slop 51 spaced from the closing roller 17 than the conveyor rollers 41, 42. As a result, the conveyor rollers 49, 50 of the envelope discharge path 3 operatively engage at a considerably greater distance from the edge of an envelope being guided along that stop 51 than the conveyor rollers 41, 42. this provides the advantage that when during the discharge of an envelope the number of the conveyor rollers 41, 42 that engage that envelope decreases and the distance along which the envelope is guided by the stop 51 is reduced—so that the guidance of the envelope decreases and the envelope might rotate more readily—the conveyor rollers 49, 50 of the envelope discharge path 3, engaging the envelope more centrally, take over the transport and the guidance of the envelope, so that rotation of the envelope is prevented.

The conveyor rollers 41 of the second envelope support 11 located remote from the first surface 12 can be transferred from a condition where they have been urged towards the opposite conveyor rollers 42 (see FIGS. 2 and 3B) to a condition where they are spaced from the opposite conveyor rollers 42 and allow the infeed of a document in the direction indicated by the arrow 35 (see FIGS. 1, 3A, and 3C) vice versa. To that end, these rollers 41 are suspended in a rocker 54 which is pivotable about a shaft 55. The rocker 54 is tilted by a spring 56 in such a manner that the rollers 41 are urged towards the rollers 42. By means of a cam 57 the rocker can be tilted against the force exerted by the draw spring 56, in such a manner that the rollers 41 are held at a distance from the rollers 42.

Owing to the envelope discharge path 3 having a portion with a lateral directional component with respect to the feed paths 4, 22, the apparatus can be made of compact design. In spite of this, the envelopes need not be bent upon being filled. When transferring the envelopes to a position against the second surface 13, they can silt freely from the first envelope support 10, the press-on roller 18 only playing a role insofar as this is needed for bending the flap 38. Thereafter, the path along which the envelopes are further displaced bends exclusively in the plane in which the envelopes are held and not in a plane intersecting or crossing the envelope.

Owing to the closed envelopes being discharged in a direction transverse to the feeding direction of the documents, a further advantage is gained in that they are diverted to the side of a generally very elongated mail processing apparatus, where they are properly visible and accessible to the operator of the apparatus, so that the progress of the insertion process can easily be monitored. Owing to one of the closing rollers 17, 37—the lower closing roller 37 in the example shown—being retractable, the closed envelopes can be discharged in transverse direction without having to convey them between the closing rollers until the trailing edge of the envelope is clear of the nip between those closing rollers. In order to enable the closing roller 37 to be moved from its position pressed against the closing roller 17 to its position displaced away from the closing roller 17 vice versa, the closing roller 37 is suspended in a rocker 58 which is likewise pivotable about the shaft 55. Engaging the rocker 58 is a draw spring 59 which tilts the rocker 58 in such a manner that the closing roller 37 is urged to the closing roller 17. Through a cam 60 the rocker 58 can be tilted against the force exerted by the draw spring 60, in such a manner that the closing roller 37 is held at a distance from the closing roller 17.

The apparatus shown further comprises a press-on body 61 extending over an important part of the width of the second envelope support 11, which press-on body 61 is reciprocally movable between a first position on the side of the first surface 12 remote from the second surface 13 (see FIGS. 1, 3A and 3C) and a second position close to the second surface 13, in which the press-on body 61, for the purpose of cooperating with a supporting surface 62 proximal to the first surface 12, is urged towards that opposite supporting surface 62 (see FIG. 3B).

With the aid of this press-on body 61 an envelope 291, prior to the closure of the flap 38', is subjected to a press-on force over at least a large part of its width in or adjacent a surface against which the flap 38' abuts after closure. Especially when closing envelopes with a relatively thick content, this provides the advantage that the occurrence of so-called false folds and creases during the closure of the flap is avoided. The width of the press-on body is preferably at least one-third of the width of the second envelope support 11. In general, a greater width of half to two-thirds of the width of the second envelope support 11 is conducive to the effectiveness of the press-on body 61.

The press-on roller 18 and the press-on body 61 are suspended from a common support 63. This support 63 is pivotable about a shaft 64 and coupled via an intermediate arm 65 to a trailing arm 66 which is operated by a cam 67 of a shaft 68. For exerting a force towards the second surface, the support 63 is coupled with a spring element, not shown.

Figure 4:
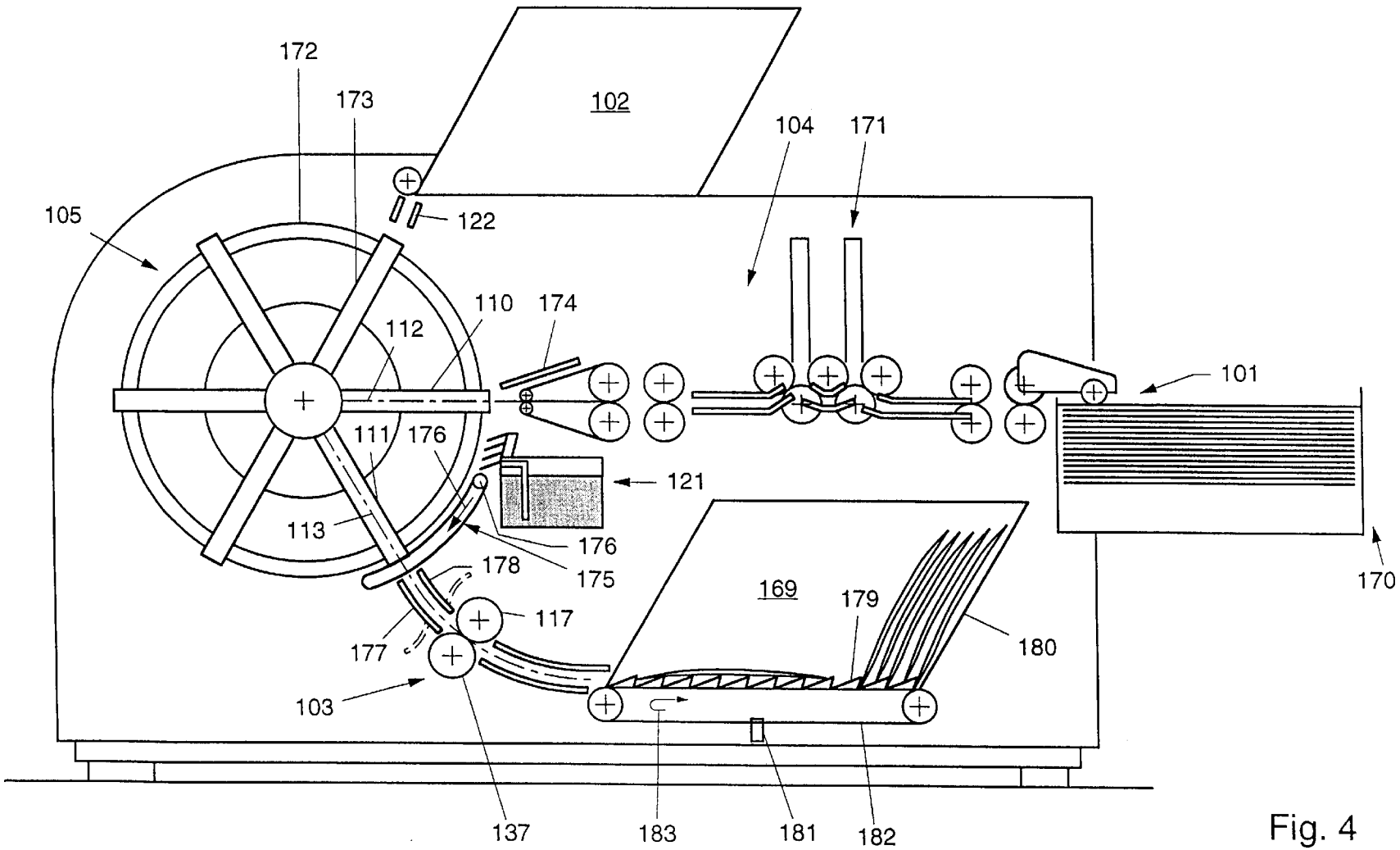
FIG. 4 is a schematic representation in side elevation of an apparatus according to a second embodiment of the invention.
Figure 5:
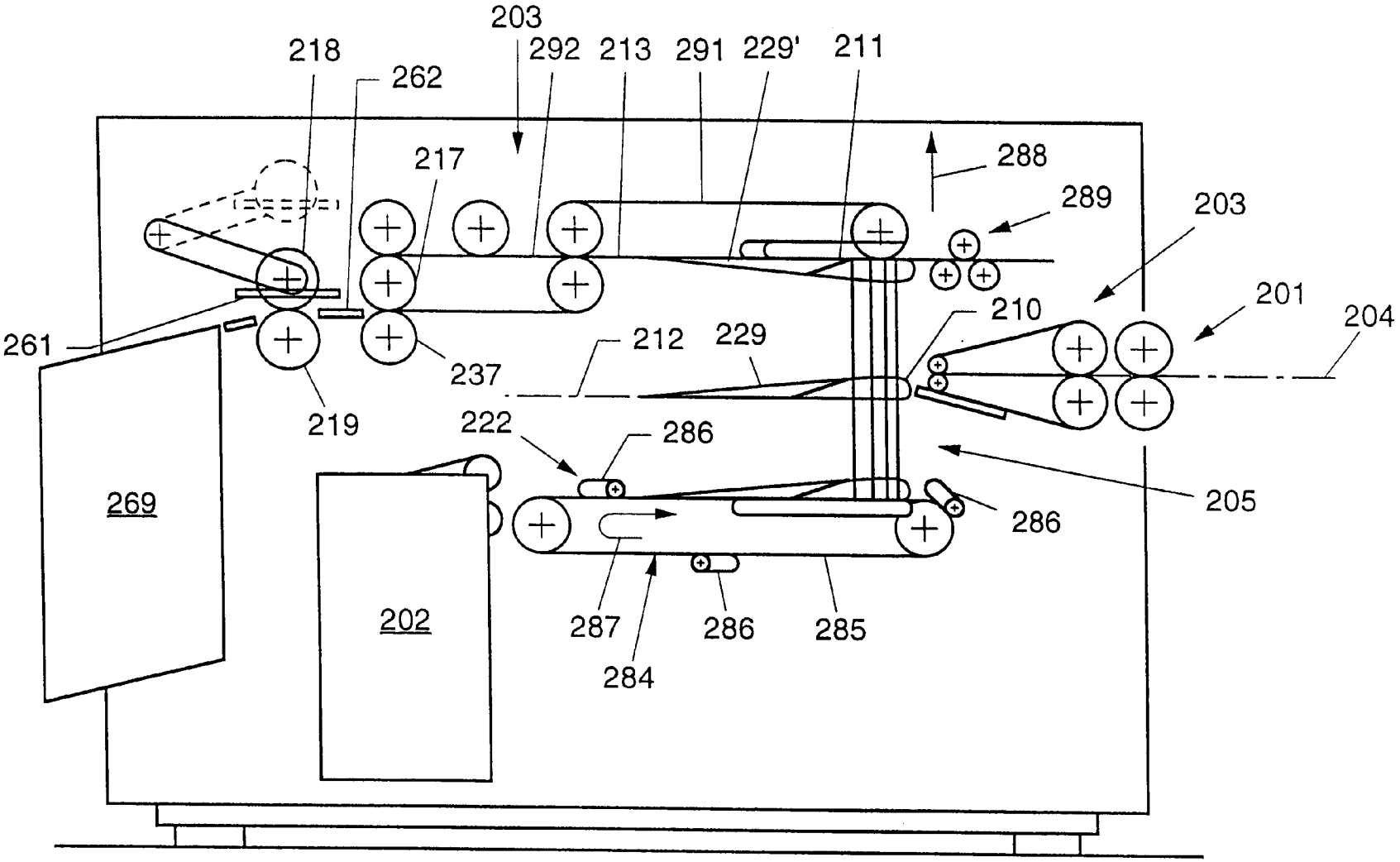
FIG. 5 is a schematic representation in side elevation of an apparatus according to a third embodiment of the invention.

The apparatuses according to FIGS. 4 and 5 each also comprise an inlet 101, 201 for documents, a supply holder 102, 202 for envelopes to be filled, a feed path 104, 204 for documents to be inserted into envelopes and an envelope discharge path 103, 203 tor discharging filled envelopes. In both apparatuses the discharge path terminates in a holder 169, 269 for collecting tilled envelopes. In the apparatus according to FIG. 4, moreover, a supply holder 170 for documents to be packaged is connected directly to the inlet 101 and the inlet is provided with a separator, known per so, for dispensing envelopes one by one from the holder 170. The apparatus according to FIG. 5, like the apparatus according to FIGS. 1–3C, is arranged for cooperating with upstream stations for adding and processing documents.

In the apparatuses according to FIG. 4, the document feed path 104 further includes a folding station 171. This folding station is of a very common construction, known per se, and therefore not described in detail here. For the rest, the feed path 104 is substantially equal to the feed path 4 of the apparatus according to FIGS. 1–3C.

The envelope holder 105 of the apparatus according to the exemplary embodiment shown in FIG. 4 comprises six envelope supports uniformly distributed over the circumference of a rotatable carrying rotor 172. Stationary ends of an envelope feed path 122, the document feed path 104 and the envelope discharge path 103 are arranged with a spacing corresponding to the distribution of the envelope supports in circumferential direction along the outer circumference of the rotor 172. When a first one of the envelope supports 110 is in a position such that it operatively aligns with the document feed path 104 for holding an envelope in the filling position in a first surface 112, a second one of the envelope supports 111 is in a position in which it operatively aligns with the envelope discharge path 103 for holding and guiding an already filled envelope in and along a second surface 113 displaced relative to the first surface 112. Simultaneously, another one of the envelope supports 112 is in a position operatively aligning with the envelope feed path 122 for receiving a supplied envelope. Thus, simultaneously an envelope and a document can be supplied to the envelope holder 105 and a filled envelope can be discharged from the envelope holder. In this way, firstly, the filling position is cleared very soon after the filling of an envelope for receiving a next envelope to be filled and the next envelope which has been brought into the proximal one of the envelope supports can be brought very rapidly into the filling position. Each time the rotor rotates further for rotating an envelope support 110 accommodating a filled envelope to the second surface 113, an envelope in a next envelope support is brought into the filling position and another, next envelope support is brought into the position facing the end of the envelope feed path 122.

For holding open the flap during the filling of an envelope in the first envelope support 110, there is arranged adjacent the downstream end of the document feed path a flap catcher 174, against which in operation the flap of an envelope to be filled abuts in the filling position.

Further, along the circumference of the rotor a flap wetter 121 and a flap fold-over unit 175 are arranged. The flap fold-over unit 175 is equipped with a rod 176.1 and a drive, not shown, for moving the rod 176 in the direction indicated by an arrow 176, in correspondence with the rotation of the rotor 172, as soon as the trailing end of the flap of an envelope in a passing envelope support has passed the lap fold-over unit rod 175. During this movement the rod 176 engages the open flap and initiates the closure of the flap of the envelope. Guides 177, 178 along an initial portion of the envelope discharge path are pivotable to a position indicated in dots, in order to allow the passage of the flap which is folded over. When the flap has been folded over, the guides 177, 178 return to the position represented by solid lines and the envelope can be discharged along the envelope discharge path 103, with the closure of the flap being completed when it passes between closing rollers 117, 137.

The holder for processed envelopes is provided with a toothed bottom 179 and a limitation 180 inclined away from the supply side. Further, in the bottom 179 slots not visible in the drawing are provided, through which a finger 181 of a circulating conveyor belt 182 can be passed. In operations the conveyor is moved in the direction indicated by an arrow 183, so that envelopes are brought in a row-shaped position leaning against the limitation 180. Sagging of the envelopes is prevented by the toothing in the bottom 179 of the holder 169. The finger 181 is so designed that it yields when it sustains a slight resistance. Thus the finger 181, during continuous circulation, engages an envelope disposed on the bottom 179 and the engagement is lost when the envelope in question has been brought into a position where it leans against the limitation 180 or against one or more envelopes by then leaning against that limitation.

In the apparatus according to FIG. 5 too the feed path 204 is substantially equal to the feed path 4 of the apparatus according to FIGS. 1–3C and the supply holder 202 is provided with a separator, known per se, for dispensing individual envelopes from the supply holder 202 one by one.

To the supply holder 202 connects an envelope feed path 222 which includes a circulating conveyor 289 and envelope grippers 286 arranged on that conveyor. In operation, the conveyor 285 is driven in the direction indicated by an arrow 287.

The apparatus further comprises an envelope holder 205 in the form of a pair of opposite chain conveyors, on which envelope supports are arranged for holding envelopes fixed in a slightly open position. Such chain conveyors with envelope supports are known, for instance, from international patent application WO 95/13197. The chain conveyor is operatively driven for displacing envelopes in a direction indicated by an arrow 288.

In operation, envelopes dispensed by the separator of the supply holder 202 are transferred to a pair of the grippers 286. When the grippers 286 holding an envelope pass a set of the envelope supports, the envelope is transferred to those envelope supports. A first set of the envelope supports 210 is then in a position operatively aligning with the document feed path 204 for holding an envelope to be filled 229 in a filling position in a first surface 211. A second bet of the supports 211, which hold an envelope 229' with a filling arranged therein, is simultaneously disposed in a position in which that envelope 229' is held ill a second surface 213 spaced from the first surface 212.

The apparatus further comprises an ejector 289 for removing the envelope 229' from the envelope support 211 which is holding an envelope in the second surface 213. While an envelope 229 held in the first surface by the first envelope support 210 is being filled, an envelope held by the second envelope support in a second surface 213 spaced from the first surface can thus be delivered.

Owing to the filled envelope being brought from the first surface to the second surface and the apparatus comprising several envelope supports, one of which is positioned for holding an envelope to be filled in the first surface when another one is positioned for delivering a filled envelope into a second surface spaced from the first surface, the filling position is operational again very quickly after the filling of an envelope, for the purpose of receiving a next document or a next set of documents in an envelope.

Filled envelopes delivered from the envelope holder 205 are further processed in the envelope discharge path 203. The initial portion of this path 203 is formed by a first conveyor 291, behind a downwardly directed surface of which a reduced pressure is created for holding envelopes 229' ejected from the envelope support 211. Connecting downstream to the first conveyor 291 is a further conveyor 292 with separate opposite conveyor rollers. Arranged downstream behind this further conveyor 292 are a press-on roller 218 and a press-on body 261 substantially corresponding to the press-on roller 18 and the press-on body as shown in FIGS. 1 and 3A–3C. Further, the downstream end pulley of the further conveyor 292 is designed as a closing roller 217, and a second closing roller 237 is located under the closing roller 217. The nip between these closing rollers 217 and 237 is located in the same plane as a supporting surface 262 and an upwardly turned circumferential portion of a conveyor roller 219.

In operation, the envelopes pass over the further conveyor 292 with the flap turned down and iii trailing position. As soon as in operation the folding edge along which the flap of a supplied envelope connects to a wall of that envelope has reached the downstream end of that further conveyor 292, the press-on roller 218 is brought from the position shown in dots into the position shown in solid lines. The closure of the flap of the envelope is thereby initiated in approximately the same way as has been described with reference to FIG. 3C. Next, the closure of the flap is completed in that it passes through the nip between the closing rollers 217 and 237 in a similar manner to that described with reference to FIG. 3A. Thereafter, however, the envelope is not transported further but the closing roller 237 is briefly moved away from the closing roller 217 and the direction of movement of the conveyor roller 219 is inverted, so that the filled and closed envelope is further discharged to the holder for filled and closed envelopes 269.

In the embodiments of apparatuses according to the invention as shown in FIGS. 4 and 5, the envelope supports are movable between the position operatively aligning with the document feed path and the position operatively aligning with the envelope discharge oath. As a result, a very good control of the envelope transport is obtained, and the filling position can be made available for filling a next envelope again very quickly after the filling of an envelope.

We claim:

1. An apparatus for inserting documents into envelopes, comprising:

a document feed path, an envelope feed path, an envelope holder operatively connecting to the document feed path and the envelope feed path, for holding an individual envelope in a filling position at least partly in a first plane, and for subsequently guiding a filled envelope towards and thereafter into a second plane offset or tilted with respect to said first plane, means for introducing at least one document into an envelope being held in the filling position, means for at least partially folding over an envelope flap of the filled envelope as the filled envelope is guided towards and into said second plane, and an envelope discharge path operatively connecting to said envelope holder, wherein the envelope holder comprises at least a first envelope support and a second envelope support, the first envelope support being located in a position operatively connecting to the document feed path for holding an envelope in the filling position at least partly in said first plane, and the second envelope support supporting the filled envelope directly after the first envelope support and being located in a position for carrying the filled envelope so that said filled envelope and an envelope which is simultaneously held in the filling position by the first envelope support are at least partly in a transversely overlapping relationship with one another.

2. An apparatus according to claim 1, wherein said second envelope support is in a position operatively connecting to the envelope discharge path for holding an envelope at least partly in said second plane.

3. An apparatus according to claim 2, wherein the envelope supports are movable between said position operatively connecting to the document feed path and said position operatively connecting to the envelope discharge path, wherein said means for at least partially folding over the envelope flap of the filled envelope includes a flap fold-over unit for folding over the flap of the filled envelope in a direction of movement of the filled envelope from said position operatively connecting to the document feed path to said position operatively connecting to the envelope discharge path.

4. An apparatus according to claim 1, wherein said means for at least partially folding over an envelope flap includes conveying means for transferring the filled envelope from said first envelope support to said second envelope support, the first and second envelope supports being arranged stationarily, wherein a portion of said feed path upstream of said first support is oriented for feeding in a feeding direction and wherein said second envelope support is at least partially located downstream in said feeding direction of said first envelope support.

5. An apparatus according to claim 4, wherein said conveying means for transferring the filled envelope from said first envelope support to said second envelope support includes a press-on roller on a downstream side of a path adjacent the filling position, which press-on roller is reciprocable between a first position opposite from an opposing conveying element and a second position close to said conveying element wherein, for the purpose of cooperation with said conveying element, the press-on roller is urged towards the conveying element, said first position of the press-on roller being on a side of the first plane opposite from the second plane and the conveying element being located on a side of the second plane opposite from said first plane.

6. An apparatus according to claim 4, further comprising a press-on body extending over at least a part of the width of an envelope path and located adjacent the filling position, which press-on body is reciprocable between a first position remote from an opposing supporting surface and a second position close to or against said supporting surface wherein, for the purpose of cooperation with said supporting surface, the press-on body is urged towards the supporting surface, said first position of the press-on body being on a side of the first plane remote from the second plane and the supporting surface being defined by a surface of the second envelope support.

7. An apparatus according to claim 6, wherein said conveying means for transferring the filled envelope from said first envelope support to said second envelope includes a press-on roller on a downstream side of a path adjacent the filling position, which press-on roller is reciprocable between a first position opposite from an opposing conveying element and a second position close to said conveying element wherein, for the purpose of cooperation with said conveying element, the press-on roller is urged towards the conveying element, said first position of the press-on roller being on a side of the first plane opposite from the second plane and the conveying element being located on a side of the second plane opposite from said first plane, and wherein the press-on roller and the press-on body are suspended from a common support.

8. An apparatus according to claim 1, further comprising a pair of closing rollers located downstream of the first envelope support.

9. An apparatus according to claim 8, wherein one of said closing rollers is located on a side of said second plane proximal to said first plane and further has a peripheral portion located substantially in the first plane defined by the first envelope support.

10. An apparatus according to claim 9, wherein the filled envelope includes a flap and a folding edge, the envelope discharge path extending in a direction which has a portion with a directional component that is laterally oriented with respect to the document and envelope feed paths and that is in the direction of the folding edge of the filled envelopes in the filling position, and wherein at least one of the closing rollers is retractable.

11. An apparatus according to claim 8, wherein one of said closing rollers is located on a side of said second plane proximal to said first plane and further is located next to the first envelope support.

12. An apparatus according to claim 1, wherein the envelope discharge path has a portion with a lateral directional component with respect to the document and envelope feed paths.

13. An apparatus according to claim 1, wherein the first plane is defined by a surface of the first envelope support, and the second plane is a defined by a surface of the second envelope support, the envelope being held at least partly against said first surface in said filling position.

14. An apparatus according to claim 1, further including a pair of envelope flap closing rollers, wherein said pair of envelope flap closing rollers define an envelope closing nip in said second plane for closing a flap of an envelope passing from said second envelope support through said nip.

15. A method for inserting documents into envelopes, comprising: feeding at least one document in a filling direction along a document feed path to an envelope positioned at a filling position in a first plane, thereafter introducing the at least one document into the envelope at the filling position to produce a filled envelope, subsequently discharging the filled envelope from the filling position via a feed-through path into a second plane situated directly after the first plane and offset or turned relative to said first plane, folding a flap of said filled envelope into a position projecting transversely from walls of the envelope during said discharge from the filling position via the feed-through path into said second plane, and bringing a next envelope to be filled into the filling position, the next envelope to be filled being brought into the filling position before the preceding, filled envelope has left the second plane, and with the next envelope that is brought into the filling position temporarily transversely overlapping the preceding, filled envelope in the second plane.

16. A method according to claim 15, which further comprises closing the filled envelope while the filled envelope is disposed in said second plane, the filled envelope having a length in the filling direction, wherein a distance over which the filled envelope is displaced in the filling direction after being filled and prior to being closed is less than said length of the filled envelope.

17. A method according to claim 15, wherein the filled envelope includes a folding edge extending along the flap, and wherein the at least partial folding over of said flap of said filled envelope during said displacement of the filled envelope from a position in the first plane to a position in the second plane orientates the flap such that the flap extends transversely relative to walls of the envelope.

18. A method according to claim 17, wherein the folding of the flap is obtained by pressing the filled envelope towards said second plane.

19. A method according to claim 15, wherein the filled envelope includes a flap, and prior to closure of the flap the filled envelope is pressed over at least a part of its width, in or adjacent a surface against which the flap abuts after the closure.

20. A method according to claim 15, further comprising: closing the flap of the filled envelope by moving the envelope parallel to said second plane, with a folding edge between the flap and a wall of the filled envelope being in a leading position, between a pair of opposing flap closing rollers.

21. A method according to claim 15, wherein the envelope includes a folding edge between the flap and a wall of the envelope, and further comprising: closing the filled envelope after the at least one document has been inserted into the envelope to produce a closed envelope, the closed envelope being discharged in a direction lateral to the direction in which the at least one document is fed to the envelope located in the filling position, said direction in which the closed envelope is discharged having a component in the direction of the folding edge of the envelope in the filling position.

22. A method according to claim 15, wherein the first plane is defined by a surface of the first envelope support, and the second plane is a defined by a surface of the second envelope support, said envelope at said filling position being positioned at least partly against the first surface.

23. An apparatus for inserting documents into envelopes, comprising:

a document feed path;

an envelope feed path;

at least two envelope supports, a first one of said envelope supports being operatively connected to said document feed path and said envelope feed path, for holding an individual envelope in a filling position at least partly in a first plane, and a second one of said envelope supports supporting a filled envelope directly after the first envelope support and being located downstream of said first envelope support for carrying said filled envelope at least partly in a second plane offset or tilted with respect to said first plane, so that said filled envelope and an envelope which is simultaneously held in the filling position by the first envelope support are at least partly in transversely overlapping relationship with one another;

means for introducing at least one document into an envelope held at said filling position of said first envelope support;

means for at least partially folding over an envelope flap of the filled envelope as the filled envelope is guided towards and into said second plane; and an envelope discharge path located downstream of said second envelope support.

24. A method for inserting documents into envelopes, comprising:

feeding at least one document along a document feed path to an envelope positioned in a filling position located at least partially in a first plane;

introducing said at least one document into said envelope to produce a filled envelope;

displacing said filled envelope from said filling position into a next position at least partially in a second plane situated directly after the first plane and offset or tilted relative to said first plane;

folding a flap of said filled envelope into a position projecting transversely from walls of the envelope during said discharge from the filling position via a feed-through path into said second plane; and moving a next envelope in a feeding direction into said filling position while said filled envelope is in said next position so that said filled envelope and the next envelope which is simultaneously held in the filling position are at least partly in transversely overlapping relationship with one another; and discharging said filled envelope from said next position.

* * * * *